United States Patent [19]

Delmerico et al.

[11] Patent Number: 5,070,574

[45] Date of Patent: Dec. 10, 1991

[54] MOP WRINGER

[75] Inventors: Paul E. Delmerico; Greg P. Terek, both of Winchester, Va.

[73] Assignee: Rubbermaid Commercial Products Inc., Winchester, Va.

[21] Appl. No.: 506,954

[22] Filed: Apr. 10, 1990

[51] Int. Cl.[5] ..... A47L 13/146

[52] U.S. Cl. ..... 15/261; 68/241; 100/233; D 32/54

[58] Field of Search ..... 15/261; 68/241; 100/233; D 32/54

[56] References Cited

U.S. PATENT DOCUMENTS

| | | | |
|---|---|---|---|
| D 250,507 | 12/1978 | Raftery et al. | D 7/187 |
| D 255,976 | 7/1980 | Maza et al. | D 7/187 |
| D 305,170 | 12/1989 | Jaros et al. | D 32/54 |
| 1,082,864 | 12/1913 | Gilchrist | 15/261 |
| 1,157,152 | 10/1915 | Davis | 15/261 |
| 1,268,921 | 6/1918 | Brace | 15/261 |
| 1,434,534 | 11/1922 | Eiffe | 15/261 |
| 1,452,798 | 4/1923 | Eaton | 15/261 |
| 2,127,045 | 8/1938 | Pavek | 15/261 |
| 4,047,261 | 9/1977 | Rones | 15/261 |

OTHER PUBLICATIONS

Continental Manufacturing Company, 123 Byassee Drive, Hazelwood, MO 63042 Advertising Sheet, 1989.

Geerpres, P.O. Box 658, Muskegon, MI 49443, Advertising Sheet, 1989.

White, P.O. Box 16647, Tampa, FL 33687, Advertising Sheet, 1989.

EWU International Ltd., 20 Romanelli Avenue, S. Hackensack, NJ 07606, Advertising Sheet, 1989.

*Primary Examiner*—Chris K. Moore

*Attorney, Agent, or Firm*—Renner, Kenner, Greive, Bobak, Taylor & Weber

[57] ABSTRACT

A mop wringer (10), which is adapted to be positioned on the rim of a pail or the like, includes a body member (11) having a front wall (14). A pressure plate (30) is pivotally connected to the body member (11). The inner surface of the front wall (14) has passageways (15A) therein and the outer surface of front wall (14) is formed with a downturned lip (59) to define additional passageways (15B) below the passageways (15A). A rotatable arm (41) carries a linkage mechanism (49) which is connected to the pressure plate (30). Rotation of the arm (41) pivots the plate (30) to evacuate water out of a mop positioned between the plate (30) and the front wall (14). The water passes through the passageways (15A) and is downwardly directed in the pail through the passageways (15B) by contact with the downturned lip (59).

30 Claims, 4 Drawing Sheets

MOP WRINGER

TECHNICAL FIELD

This invention relates to an apparatus for wringing excess liquid out of a mop. More particularly, this invention relates to a mop wringer which can be positioned on the upper rim of a bucket and activated to squeeze liquid out of the mop and into the bucket.

BACKGROUND ART

Mop wringers are known in the art of the type which are positionable on the edge of a bucket, pail or the like, which are adapted to receive a mop, and which through the movement of an arm activate a pressure plate to squeeze water out of the mop and into the bucket. In many instances the connection between the arm and the pressure plate is quite complex, costly to manufacture, difficult to assemble, and fails to provide a uniform force on the plate to efficiently remove water from the mop.

In addition, typically in these prior art devices, the pressure plate traps the mop against and squeezes it against a surface which has apertures therein and which is positioned above the confines of the bucket so that the water from the mop passes through the apertures and into the bucket. During this action it is important to direct the water downwardly into the bucket, otherwise, if it were permitted to pass straight through the apertures, it could overshoot the bucket if excessive force were exerted on the operating handle. Prior art efforts to direct the water downwardly into the bucket have generally resulted in a decrease of the open space in the apertured surface thereby causing a decrease in throughput efficiency.

Moreover, such prior art mop wringers are plagued with manufacturing and assembly deficiencies all of which significantly increases the cost thereof. For example, most mop wringers require that some sort of water dam device be positioned behind the pressure plate so that if some water being squeezed out of the mop works its way around the plate, the water dam will prevent it from splashing outside the confines of the bucket. Such are often extravagant, complex, separate parts which significantly add to the ultimate cost of the product.

DISCLOSURE OF THE INVENTION

It is thus an object of the present invention to provide a mop wringer which is easily and economically manufactured having a minimum amount of material for the strength needed to uniformly wring water out of mops.

It is another object of the present invention to provide a mop wringer, as above, which is easy to assemble having a minimum number of operating parts.

It is a further object of the present invention to provide a mop wringer, as above, with a linkage assembly connecting the operating handle to the pressure plate which efficiently provides a uniform mop wringing force across the entire width of the pressure plate.

It is an additional object of the present invention to provide a mop wringer, as above, in which the mop is squeezed against a surface having apertures therein which direct the water downwardly into the bucket without adversely effecting the throughput efficiency.

These and other objects of the present invention, as well as the advantages thereof over existing prior art forms, which will become apparent from the description to follow, are accomplished by the means hereinafter described and claimed.

In general, a mop wringer according to the present invention is adapted to be positioned on the rim of a pail, bucket or the like and includes a body member having a front wall having inner and outer surfaces. A pressure plate is pivotally connected to the body member having a pressure surface which faces the inner surface of the front wall with the mop positioned therebetween. The inner surface of the front wall has apertures therein and the outer surface is formed with a downturned lip defining additional apertures below the apertures in the inner surface. A rotatable arm carries a linkage mechanism which is connected to the pressure plate such that upon rotation of the arm, pressure is applied evenly to the plate to evacuate water out of the mop, through the apertures in the inner surface of the front wall, against the downturned lip, through the additional apertures, and into the pail.

A preferred exemplary mop wringer incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
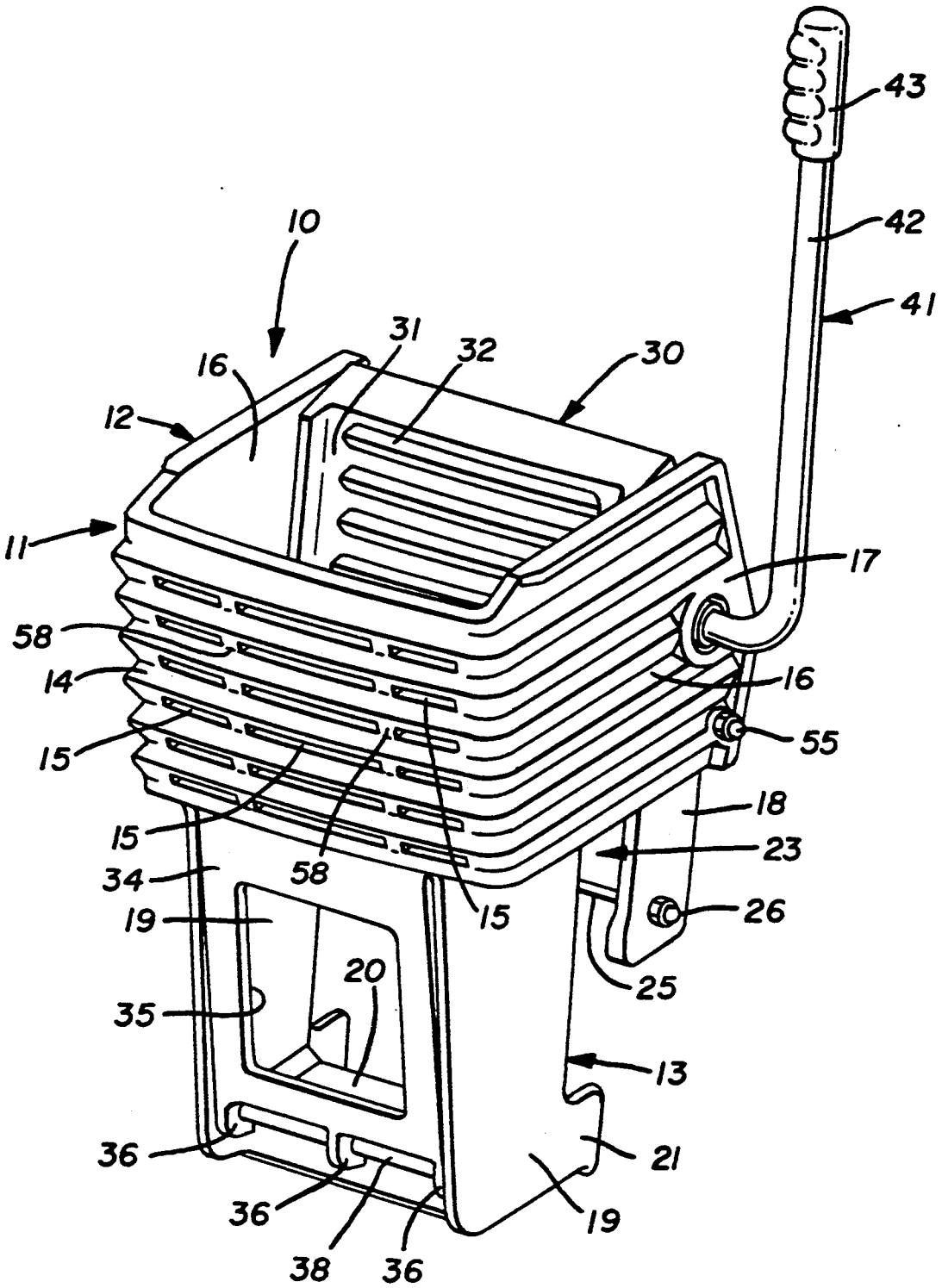
FIG. 1 is a front and right side perspective view of a mop wringer according to the concepts of the present invention.

A mop wringer according to the concepts of the present invention is indicated generally by the numeral 10 in the drawings, with the majority of the components of mop wringer 10 being molded of a polypropylene material. The primary component of mop wringer 10 is a body member indicated generally by the numeral 11 which includes an upper mop wringing portion indicated generally by the numeral 12 and a lower support portion indicated generally by the numeral 13, and integral with upper portion 12.

Upper portion 12 of body member 11 includes a front wall or surface 14 which externally takes on a serrated appearance and includes water evacuation holes 15 recessed therein. Upper portion 12 also includes sidewalls 16 extending rearwardly from the ends of front surface 14. The external surface of sidewalls 16 is generally serrated to aesthetically complement front surface 14 while the internal surfaces thereof are generally planar. Sidewalls 16 terminate at their rear end as linkage mounting portions 17 which together define an open rear end of upper portion 12 of body member 11. Pail gripping lugs 18 extend generally downwardly from each sidewall 16 generally below mounting portions 17.

Lower portion 13 of body member 11 is configured generally as a U-shaped frame having upstanding side branches 19 spanned by a cross branch 20 forming the bottom of lower portion 13. The lower portion of side branches 19 is provided with rearwardly extending flanges 21 which provide additional support for a rearward projection 22 of cross branch 20. A slot 23 formed between the rear edge of each side branch 19 and the front edge of each lug 18 is adapted to receive the upper rim of a pail, bucket or the like (not shown) onto which body member 11 is designed to be positioned. With the rim of a pail positioned in slot 23, the pail is engaged between the front edge of lug 18, which has a reinforcing peripheral flange 24 on the inside thereof, and projection 22 of cross branch 20 of lower portion 13 of body member 11. As such, body member 11 will rest in a generally vertical position on an edge of the pail with the lower portion 13 thereof being within the confines of the pail, with lugs 18 of upper portion 12 being on the outside of the pail, and with the remaining members of upper portion 12 being located above the pail. If necessary, a rod 25 attached to lugs 18, as by nuts 26, can be provided to effectively tie lugs 18 together for structural strength.

Body member 11 carries a pressure plate, indicated generally by the numeral 30, which is movable to squeeze water out of a mop placed within body member 11 between plate 30 and front surface 14. Pressure plate 30 includes a generally upright pressure surface 31 having triangular projections 32 formed in at least a portion of the front face thereof. It has been found that such projections aid significantly in gripping the mop and squeezing the same to extract water therefrom. A shelf 33 extends generally horizontally outward from the lower portion of pressure surface 31 to a point, when pressure plate 30 is in its relaxed or retracted position shown in FIG. 3, generally coincident with the plane of front surface 14 of upper portion 12 of body member 11. The outer end of shelf 33 turns downwardly to form a front face 34 of plate 30 which is located between branches 19 of the U-shaped frame of lower portion 13 of body member 11. Since structural strength is not required for front face 34, an aperture 35 may be provided therein to reduce material costs in manufacturing mop wringer 10 and to also reduce the overall weight thereof. The lower portion of face 34 is shown as being provided with three hook members and an opposed tongue 37 which are adapted to engage a fixed pivot shaft 38 which spans branches 19 of the U-shaped frame. There is sufficient flexibility in the polypropylene material from which plate 30 is preferably manufactured such that plate 30 may be readily attached to shaft 38 by merely snapping hooks 36 and tongue 37 over shaft 38 and plate 30 is thereafter rotatable on the axis defined by shaft 38.

Figure 2:
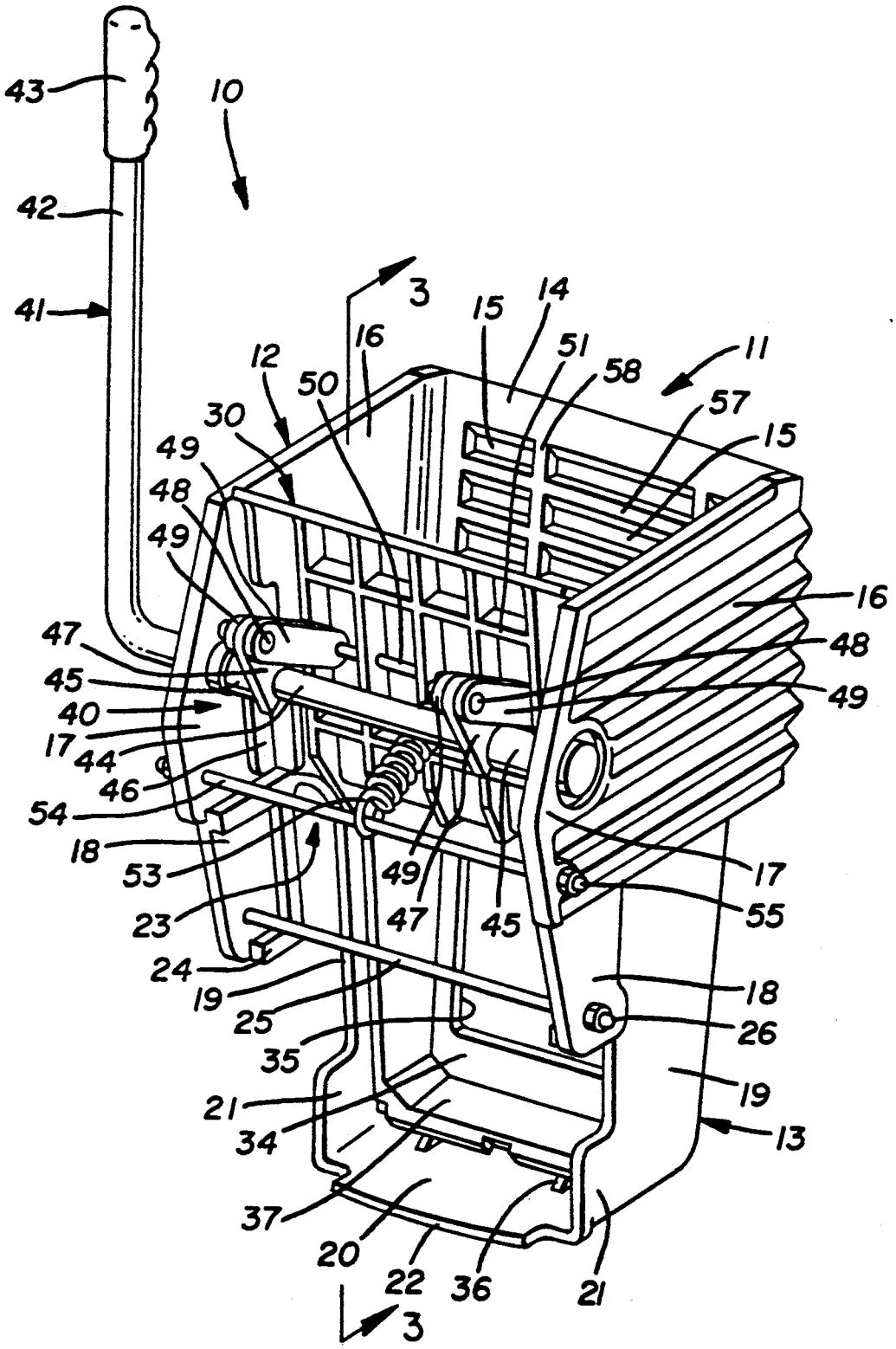
FIG. 2 is a rear and left side perspective view of the mop wringer shown in FIG. 1.
Figure 4:
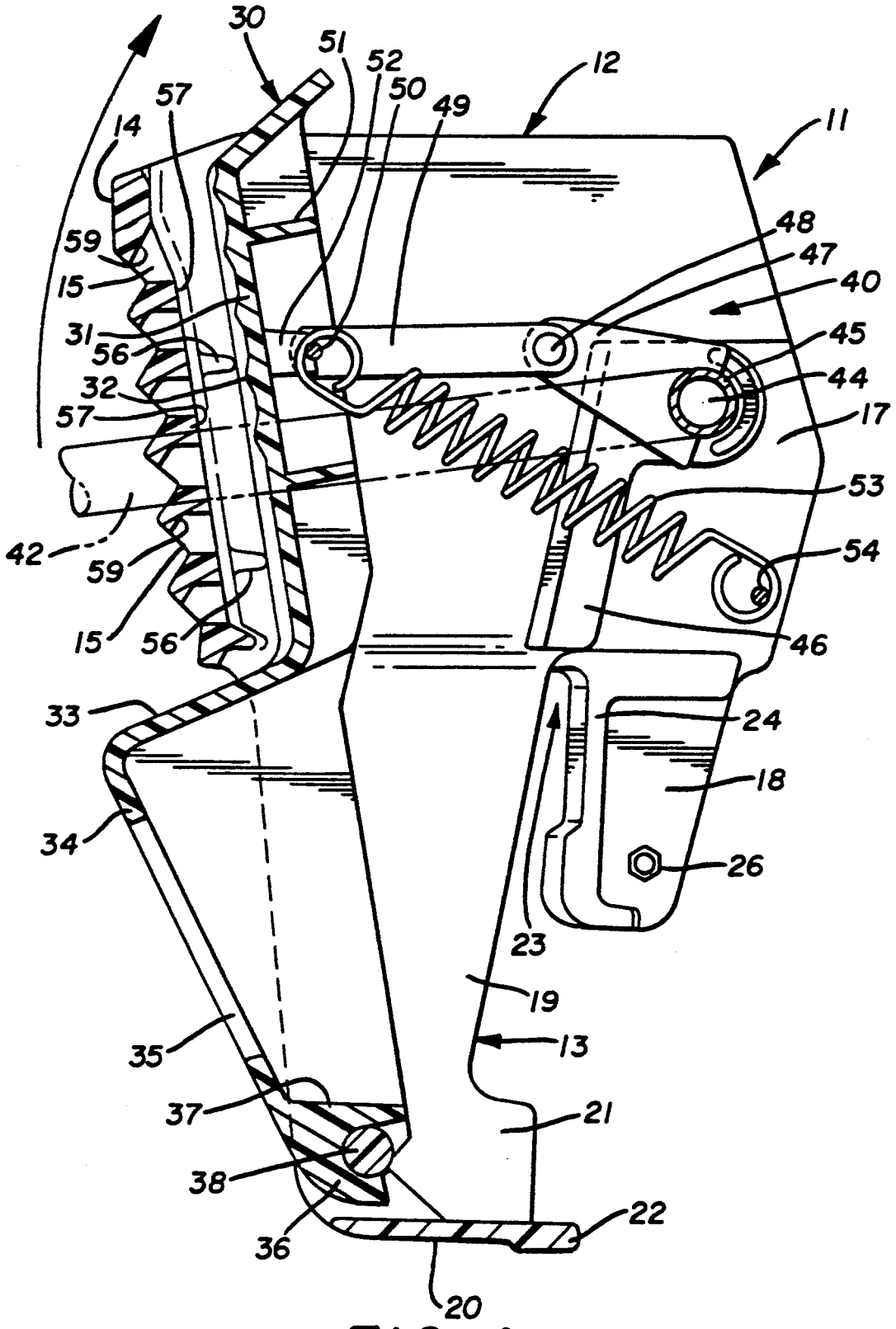
FIG. 4 is a sectional view similar to FIG. 3 but showing the mop wringer as it is being actuated.

The operating mechanism by which pressure plate may be rotated about shaft 38 is indicated generally by the numeral 40 and includes an L-shaped operating arm indicated generally by the numeral 41. Operating arm 41 is preferably a metallic member and includes a generally upright handle portion 42, having a plastic grip member 43 on the end thereof, and a generally horizontal operating shaft 44 which is journalled between linkage mounting portions 17 of sidewalls 16. Tubular bushing members 45, which can be molded of a plastic material, are press fit in openings in mounting portions 17 to support shaft 44. As best shown in FIGS. 2 and 4, each bushing member 45 has a downwardly directed finger-like water dam component 46 molded integrally therewith, the purpose of which being hereinafter described in detail. Shaft 44 is thus supported by bushings 45 and mounting portions 17, and is rotatable upon the movement of handle portion 42 of operating arm 41.

Shaft 44 carries two throw arms 47 positioned near the outer edges thereof generally adjacent to bushings 45. Throw arms 47 are preferably metallic and somewhat triangular in configuration with the apex of each arm being pin connected, as at 48, to one end of metallic link arms 49. As shown in FIG. 2, for strength purposes there are preferably two link arms 49 for each throw arm 47, one being positioned on each side thereof; however, operating mechanism 40 would operate satisfactorily with one, possibly larger, link arm 49 for each throw arm 47. The other end of each link arm 49 engages a pressure plate mounting rod 50 located on and extending across substantially the entire rear face of pressure surface 31 of plate 30. As shown, the rear face of pressure surface 31 is honeycombed, as at 51, so that rod 50 may be attached thereto and bear thereagainst. The honeycombed nature of the rear face of pressure surface 31 also provides pressure plate 30 with the maximum strength for the minimal amount of material used. To provide an extra pressure bearing surface, within the honeycombs of the rear face of pressure surface 31, lug members 52 are provided which serve as a bearing surface against which rod 50 applies pressure upon activation of operating arm 41, which pressure is thereby uniformly distributed across surface 31. A return spring 53 extends between mounting rod 50 and a similar rod 54 extending between mounting portions 17 of sidewalls 16 and attached thereto as by nuts 55.

Figure 3:
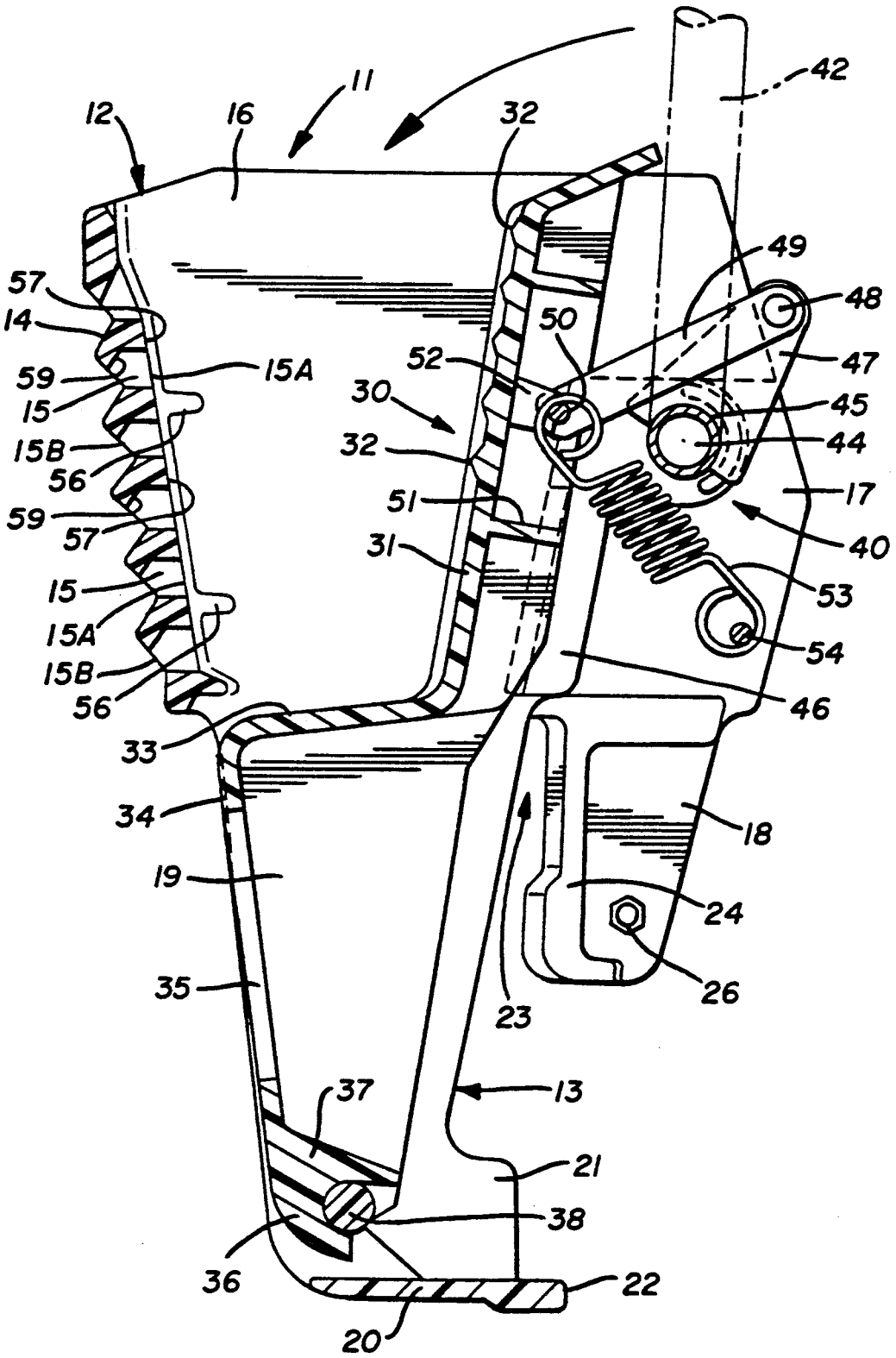
FIG. 3 is a sectional view taken substantially along line 3—3 of FIG. 2.

In operation of mop wringer 10 positioned on a pail or bucket as previously described, and with a mop to be squeezed positioned between pressure surface 31 of pressure plate 30 and front surface 14, rotation of handle 42 in the direction of the arrow in FIG. 3 moves plate 30 to the FIG. 4 position. The unique and non-complex operating mechanism 40 enables rod 50 to provide an even force across the surface of pressure plate 30 with projections 32 assisting in providing that uniform force to the mop. Stop ribs 56 molded into the inside of front surface 14 define the maximum amount of travel of plate 30. During the movement of plate 30, water in the mop is forced outwardly through evacuation holes 15. If any water is forced backward between the edge of plate 30 and the sidewalls 16 within which it travels, water dam 46 will engage the same, and being positioned generally at the location of the rim of the pail, will direct the same into the pail.

It should be noted that water forced through holes 15 is directed downwardly into the pail and cannot overshoot the pail. This is uniquely accomplished by taking advantage of the serrated outer surface of front surface 14, without detracting from the throughput efficiency of wringer 10. Thus, as water is directed toward the rear of front surface 14, it passes through the internal passageways 15A of holes 15 formed between horizontal bars 57 and vertical bars 58 and encounters an overhanging downturned lip 59, which on the other side is a serration on the front of front surface 14. At this time the water is directed through passageways 15B formed by downturned lip 59 and downwardly into the pail below. As shown, passageways 15B are only slightly smaller than passageways 15A and thus the throughput efficiency is not impeded.

It should thus be evident that a mop wringer as disclosed herein can be economically manufactured, easily assembled, and operated to provide a uniform force to the mop being squeezed thereby to direct water downwardly and efficiently into the pail positioned therebelow, thereby accomplishing the objects of the present invention and substantially improving the art.

We claim:

1. Apparatus for wringing water from a mop positioned therein, the apparatus being adapted to be carried on the rim of a pail or the like and comprising a body member having a front wall with water evacuating apertures therein; a pressure plate pivotally carried by said body member; operating means to pivot said pressure plate toward said front wall to squeeze water out of the mop positioned therebetween; said operating means including a rotatable arm member, a linkage member having first and second ends, said linkage member being carried at said first end by said arm member, and means attached to said pressure plate and carrying said second end of said linkage member so that upon rotation of said arm member, pressure is applied across said pressure plate as it moves to evacuate water out of the mop and through said apertures of said front wall of said body member; bushings carried by said body member, said arm member rotating within said bushings; and water dam means integrally formed with said bushings to prevent water which might pass between said pressure plate and said body member from passing therethrough.

2. Apparatus according to claim 1 wherein said arm member includes a normally generally vertically oriented handle portion and a generally horizontal shaft portion, said shaft portion carrying said first end of said linkage means.

3. Apparatus according to claim 2, said operating means further including a throw arm having inner and outer ends, said throw arm being carried by said shaft portion of said arm member, said first end of said linkage means being attached to said outer end of said throw arm.

4. Apparatus according to claim 2, said shaft portion of said arm member rotating within said bushings.

5. Apparatus according to claim 1 wherein said means attached to said pressure plate includes a rod member extending across substantially the entire width of said pressure plate.

6. Apparatus according to claim 5 wherein said pressure plate includes a honeycombed surface and said rod member is attached to said honeycombed surface.

7. Apparatus according to claim 6 further comprising lug members within said honeycombed surface, said rod member engaging said lug members.

8. Apparatus according to claim 1 wherein said means attached to said pressure plate includes a first rod member, said operating means further including a second rod member carried by said body member and spring means between said first and second rod members to reverse the rotation of said arm member after evacuating water out of the mop.

9. Apparatus according to claim 1 wherein said front wall of said body member has inner and outer surfaces, said water evacuating apertures including first passageways in said inner surface of said front wall, a downturned overhang in said outer surface of said front wall, and second passageways below said downturned overhang and on said outer surface of said front wall so that water passing through said water evacuating apertures passes first through said first passageways and is directed downwardly by said overhang and through said second passageways.

10. Apparatus according to claim 9 wherein said outer surface of said front wall is provided with serrations, said serrations defining said downturned overhang.

11. Apparatus according to claim 1 further comprising a pivot shaft carried by said body member and means formed at the bottom of said pressure plate to engage said shaft so that sad pressure plate is pivotable therearound.

12. Apparatus for wringing water from a mop positioned therein, the apparatus being adapted to be carried on the rim of a pail or the like and comprising a body member having a front wall with water evacuating apertures therein; a pressure plate; a pivot shaft carried by said body member; a plurality of hook members and an opposed tongue member formed at the bottom of said pressure plate, said hook members and opposed tongue member being flexible so as to snap over said shaft yet be pivotable therearound; and operating means to pivot said pressure plate toward said front wall to squeeze water out of the mop positioned therebetween; said operating means including a rotatable arm member, a linkage member having first and second ends, said linkage member being carried at said first end by said arm member, and means attached to said pressure plate and carrying said second end of said linkage member so that upon rotation of said arm member, pressure is applied across said pressure plate as it moves to evacuate water out of the mop and through said apertures of said front wall of said body member.

13. Apparatus according to claim 1 wherein said pressure plate has a front pressure surface facing said front wall of said body member and further comprising mop engaging projections on said front pressure surface of said pressure plate.

14. Apparatus for wringing water from a mop positioned therein, the apparatus being adapted to be carried on the rim of a pail or the like and comprising a body member having a front wall having inner and outer surfaces, a pressure plate facing said inner surface of said front wall, first passageways formed in said inner surface, downturned lips formed in said outer surface and defining second passageways below said first passageways, a pivot shaft carried by said body member, a plurality of hook members and an opposed tongue member formed at the bottom of said pressure plate, said hook members and opposed tongue member being flexible so as to snap over said shaft yet be pivotable therearound, and operating means to pivot said pressure plate toward said inner surface so that water in the mop positioned between said pressure plate and said inner surface is forced through said first passageways, against said downturned lips and through said second passageways.

15. Apparatus according to claim 14 wherein said inner surface of said front wall includes a plurality of generally horizontal bars and a plurality of generally vertical bars intersecting said generally horizontal bars to form said first passageways.

16. Apparatus according to claim 14 wherein said outer surface of said front wall is serrated to form said downturned lips.

17. Apparatus according to claim 14 further comprising mop engaging projections on said pressure plate facing said inner surface of said front wall.

18. Apparatus according to claim 14 wherein said operating means includes a rotatable arm member, a linkage member having first and second ends, said linkage member being carried at said first end by said arm member, and means attached to said pressure plate and carrying said second end of said linkage member.

19. Apparatus according to claim 18 wherein said means attached to said pressure plate includes a first rod member, said operating means further including a second rod member carried by said body member, and spring means between said first and second rod members to reverse the rotation of said arm member after evacuating water out of the mop.

20. Apparatus according to claim 18 wherein said means attached to said pressure plate includes a rod member extending across substantially the entire width of said pressure plate.

21. Apparatus according to claim 20 wherein said pressure plate includes a honeycombed surface and said rod member is attached to said honeycombed surface.

22. Apparatus according to claim 21 further comprising lug members within said honeycombed surface, said rod member engaging said lug members.

23. Apparatus according to claim 14 wherein said operating means includes a rotatable arm member and means to link said arm member to said pressure plate.

24. Apparatus according to claim 23 wherein said arm member includes a generally horizontal shaft portion, said shaft portion carrying said means to link.

25. Apparatus according to claim 24 further comprising a throw arm carried by said shaft portion and attached to said means to link.

26. Apparatus according to claim 24 further comprising bushings carried by said body member, said shaft portion of said arm member rotating within said bushings.

27. Apparatus for wringing water from a mop positioned therein, the apparatus being adapted to be carried on the rim of a pail or the like and comprising a body member having a front wall having inner and outer surfaces; a pressure plate pivotally carried by said body member and facing said inner surface of said front wall; first passageways formed in said inner surface; downturned lips formed in said outer surface and defining second passageways below said first passageways; operating means to pivot said pressure plate toward said inner surface so that water in the mop positioned between said pressure plate and said inner surface is forced through said first passageways, against said downturned lips and through said second passageways; said operating means including a rotatable arm member having a generally horizontal shaft portion, and means to link said arm member to said pressure plate carried by said shaft portion; bushings carried by said body member, said shaft portion rotating within said bushings; and water dam means integrally formed with said bushings to prevent water which might pass between said pressure plate and said body member from passing therethrough.

28. Apparatus for wringing water from a mop positioned therein, the apparatus being adapted to be carried on the rim of a pail or the like and comprising a body member having a front wall with water evacuating apertures therein, a pressure plate, bushings carried by said body member, arms means rotatable in said bushings and connected to said pressure plate to pivot said pressure plate toward said front wall to squeeze water out of the mop positioned therebetween and through said apertures in said front wall, and water dam means carried by said body member to prevent water which might pass between said pressure plate and said body member from passing therethrough.

29. Apparatus for wringing water from a mop positioned therein, the apparatus being adapted to be carried on the rim of a pail or the like and comprising a body member having a front wall with water evacuating apertures therein, a pressure plate, a pivot shaft carried by said body member, a plurality of hook members and opposed tongue member formed on the bottom of said pressure plate, said hook members and opposed tongue member being flexible so as to snap over said shaft yet be pivotable therearound, and means to pivot said pressure plate on said shaft and toward said front wall so that water in the mop positioned between said pressure plate and said front wall is forced through said apertures.

30. Apparatus for wringing water from a mop positioned therein, the apparatus being adapted to be carried on the rim of a pail or the like and comprising a body member having a front wall with water evacuating apertures therein; a pressure plate pivotally carried by said body member and having a front surface facing said front wall and a rear honeycombed surface; a rod member attached to said honeycombed surface and extending substantially the entire width of said pressure plate; lug members within said honeycombed surface to be engaged by said rod member; a rotatable arm member carried by said body member; and means to link said arm member to said rod member so that upon rotation of said arm member, pressure is applied by said rod member evenly across substantially the entire width of said honeycombed surface and applied to said lug members to move said pressure plate to evacuate water out of the mop through said apertures in said front wall of said body member.

* * * * *